US005421692A

United States Patent [19]

Varrichio et al.

[11] Patent Number: 5,421,692

[45] Date of Patent: Jun. 6, 1995

[54] APPARATUS FOR ELEVATING A WHEELCHAIR

[76] Inventors: Guy Varrichio, 32 Van Wyck Dr., Princeton Junction, N.J. 08550; Rey Solani, 30 Pilot St., Bronx, N.Y. 10464; George DeSalle, 1801 S. Ocean Dr., Apt. 737, Hallondale, Fla. 33009

[21] Appl. No.: 954,041

[22] Filed: Sep. 30, 1992

[51] Int. Cl.[6] ..... A61G 7/00

[52] U.S. Cl. ..... 414/678; 414/921; 414/642; 187/200; 187/216

[58] Field of Search ..... 414/639, 640, 642, 652, 414/680, 917, 921, 462, 678; 187/8.65, 8.77; 269/226, 901

[56] References Cited

U.S. PATENT DOCUMENTS

| | | | |
|---|---|---|---|
| 4,007,960 | 2/1977 | Gaffney | 297/71 |
| 4,561,823 | 12/1985 | Norton | 414/921 X |
| 4,772,164 | 9/1988 | McFarland | 414/462 X |
| 4,909,700 | 3/1990 | Fontecchio et al. | 414/917 X |
| 4,941,799 | 7/1990 | Gordon et al. | 414/921 X |
| 5,096,008 | 3/1992 | Mankowski | 414/921 X |

FOREIGN PATENT DOCUMENTS 776610 11/1980 U.S.S.R. ..... 414/921

*Primary Examiner*—David A. Bucci
*Assistant Examiner*—Stephen Gordon
*Attorney, Agent, or Firm*—Christine Cole

[57] ABSTRACT

A lift-assist device is provided for securely clamping a wheelchair and then elevating and forwardly tipping the wheelchair to assist the occupant in rising from it to a standing position. The device operates with any conventional wheelchair design, the device having adjustment mechanisms to accommodate wheelchairs of varying size. The device eliminates the need for lift-assist wheelchairs to have their own integral lifting mechanisms which in the past have made such wheelchairs cumbersome and heavy. The present device is conveniently portable and much less expensive than wheelchairs with integral lift-assist mechanisms. Thus, the present invention provides wheelchair-bound persons with greater mobility than was previously available by greatly improving the usefulness of conventional non-lift-assist wheelchairs, which can now be given lifting assistance by the present invention in a variety of settings.

10 Claims, 6 Drawing Sheets

APPARATUS FOR ELEVATING A WHEELCHAIR

BACKGROUND OF THE INVENTION

This invention relates to an apparatus for increasing the mobility of wheelchair-bound persons, more specifically, it relates to a device suitable for elevating and forwardly tipping the seat of wheelchairs of a variety of conventional designs to assist a disabled person to arise more readily from or be seated in a wheelchair.

Disabled or aged persons confined to the use of a wheelchair for mobility often experience difficulty or require assistance when arising from the seat of a wheelchair. A relatively small forward tilt and rise of the seat assists the disabled person very substantially in standing and balancing on his feet.

An attendant is often required to lift the disabled person upward to assist him or her in attaining a standing position. Lifting of the incapacitated person is stressful for the attendant and may also expose the patient to harmful physical stress.

An additional hazard is created when the incapacitated person arising from a seated position in a wheelchair pushes against the wheelchair in order to propel his body upward and forward. If the brake(s) of the chair have not been fully engaged, the horizontal force exerted against the wheelchair may cause the chair to roll out from under the patient before the patient is fully standing on his feet, and thus cause a dangerous fall.

There are currently available wheel chairs and stationery chairs designed for disabled persons which embody means for elevating and forwardly tipping the chair seat to assist the seated occupant to arise to his/her feet. The elevating and forward seat-tipping in these earlier devices utilized many different mechanical and motor driven mechanisms to activate raised and angled repositioning of a seat when occupied by a disabled person. One such mechanism embodied in a stationery chair is disclosed in U.S. Pat. No. 4,007,960 (Gaffney). Other motor driven mechanisms disclosing variations on the Gaffney device have been mounted in wheelchairs.

All the aforesaid motor driven seat elevating and repositioning mechanisms require that the mechanism be mounted within and integral with a stationary chair or wheel chair. These mechanisms are sizeable, heavy and expensive. Thus in a nursing home or hospital requiring a plurality of wheelchairs for disabled persons, including child-sized wheelchairs, the additional cost of providing wheelchairs having self contained elevating and seat tipping motorized mechanisms is considerable.

Moreover, wheelchairs equipped with heavy and physically bulky elevating and seat tipping mechanisms are awkward and often too heavy to negotiate stairs, ramps, and curbs, or to permit lifting the wheelchair into vans or buses. While the elevating and seat tipping wheelchair provides useful assistance to a disabled person, the weight of the elevating mechanism may, because of the considerable added weight, restrict the mobility of such a person confined to a wheelchair so equipped.

Heretofore, there have been no means available, other than those embodied within the chair itself, for elevating and forwardly tipping the seat of a conventional design invalid's wheelchair. The limitation on providing a device for elevating and forwardly tipping the seat of a variety of conventional wheelchairs resided in the sheer variability in the design of wheelchairs and the difficulty of securely gripping the frame of any of a variety of invalid wheelchairs to facilitate safely elevating and tipping, respectively, the seats thereof.

OBJECTS OF THE INVENTION

A first object of the present invention is to provide a portable device for securely gripping the frame of a variety of conventional wheelchairs and when actuated gently elevating the entire wheelchair while simultaneously tipping the seat forward.

A second object of the present invention is to provide a foldable compact and portable device for securely gripping the frame of any of a variety of conventional wheel chairs while gently lifting and tilting the seat forward to assist a disabled or aged person to arise from the chair.

Another object of the present invention is to provide a portable means for fixedly restraining a wheel chair from moving horizontally so that when a disabled or aged person is endeavoring to arise from the seat thereof, the wheel chair can not roll out from beneath the patient.

Yet another object of the present invention is to provide a device for assisting an invalid or aged person from arising from a seated position in a wheelchair, which device the invalid or aged person can operate without third party assistance and which provides a high degree of safety for the disabled or aged person during all portions of the operating cycle.

SUMMARY OF INVENTION

The present invention relates to a readily portable device onto which a disabled or aged person's wheelchair may be rolled into position, whereupon the device by means of solenoid operated restraining members securely grips the frame of the wheelchair. Then, upon actuation, the portable device gently lifts the wheelchair a predetermined height while tipping the seat thereof forward, so that a disabled or aged person seated in the wheelchair may be assisted in arising from a seated position in such a wheelchair.

The portable device is operated by means of a three position switch which enables a wheelchair occupant to raise or lower the wheelchair or release the solenoid operated restraining members, thereby freeing the wheelchair to roll off the lifting device.

Other objects, qualities and advantages of my invention will be evident from the following described drawings, specifications and claims.

DESCRIPTION OF THE PREFERRED EMBODIMENT

Figure 1:
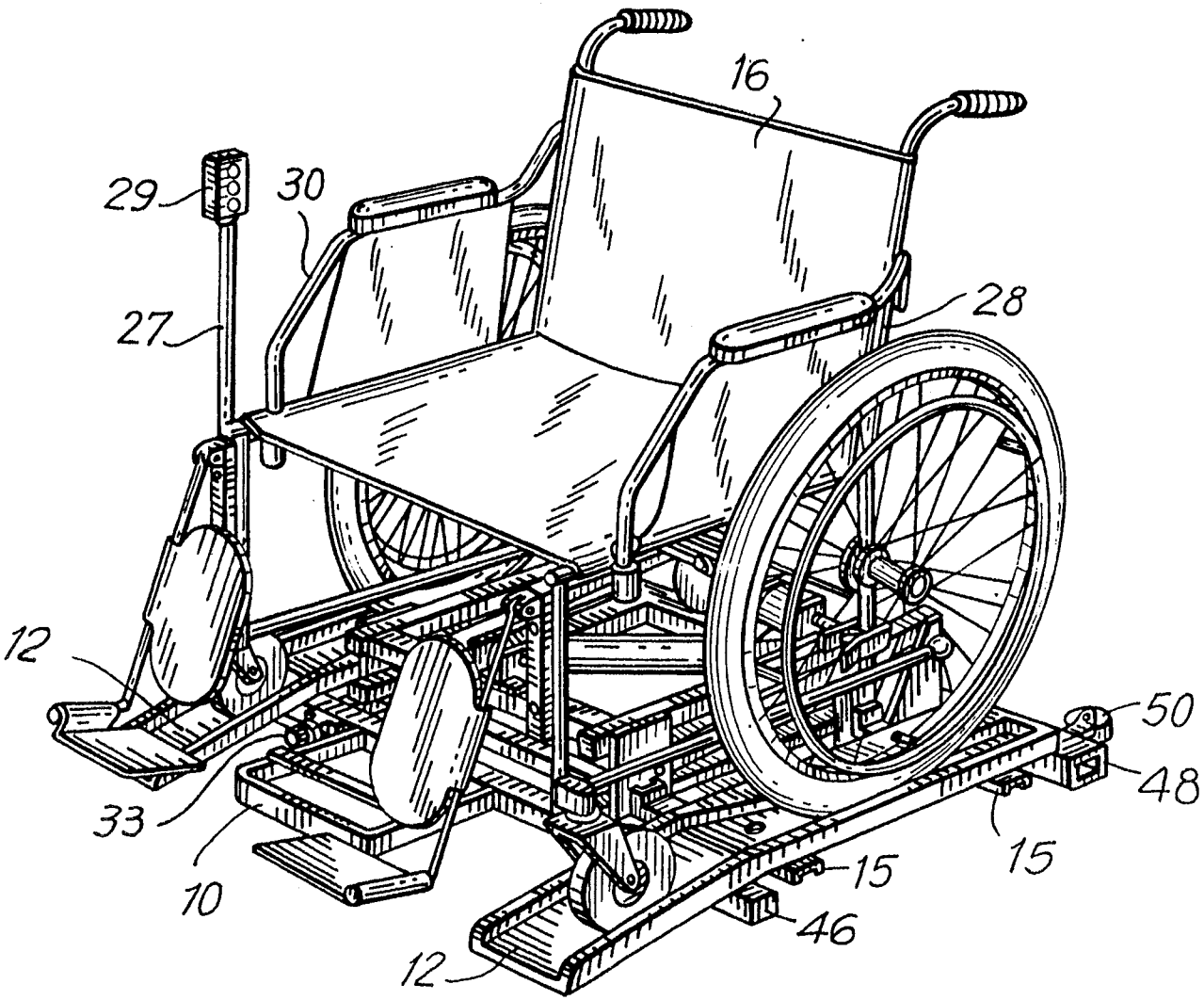
FIG. 1 is a perspective view of one embodiment of the invention in the down position with a conventional design wheelchair positioned thereon.
Figure 2:
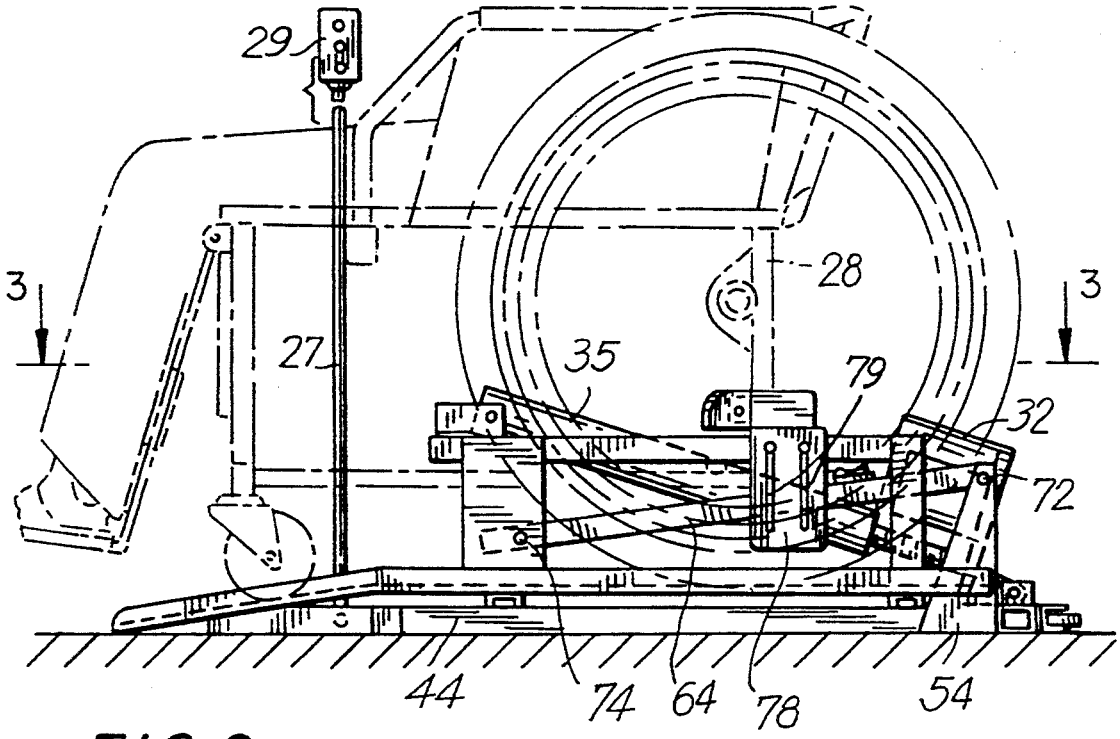
FIG. 2 is side or elevation view of the invention embodiment shown in FIG. 1 also in the down position with a portion of a conventional wheelchair shown positioned thereon.
Figure 3:
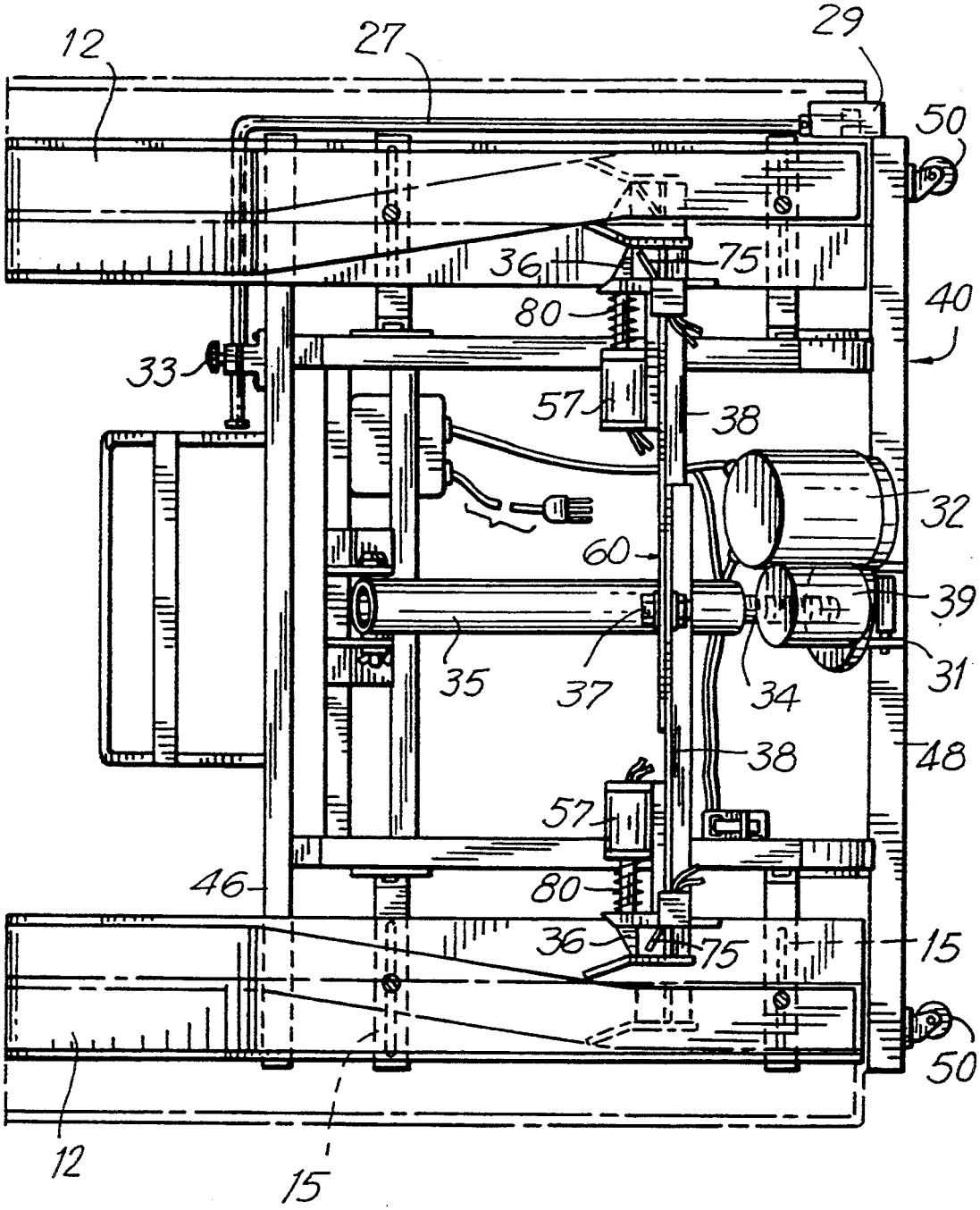
FIG. 3 is a plan view of the embodiment of the invention shown in FIG. 1.
Figure 4:
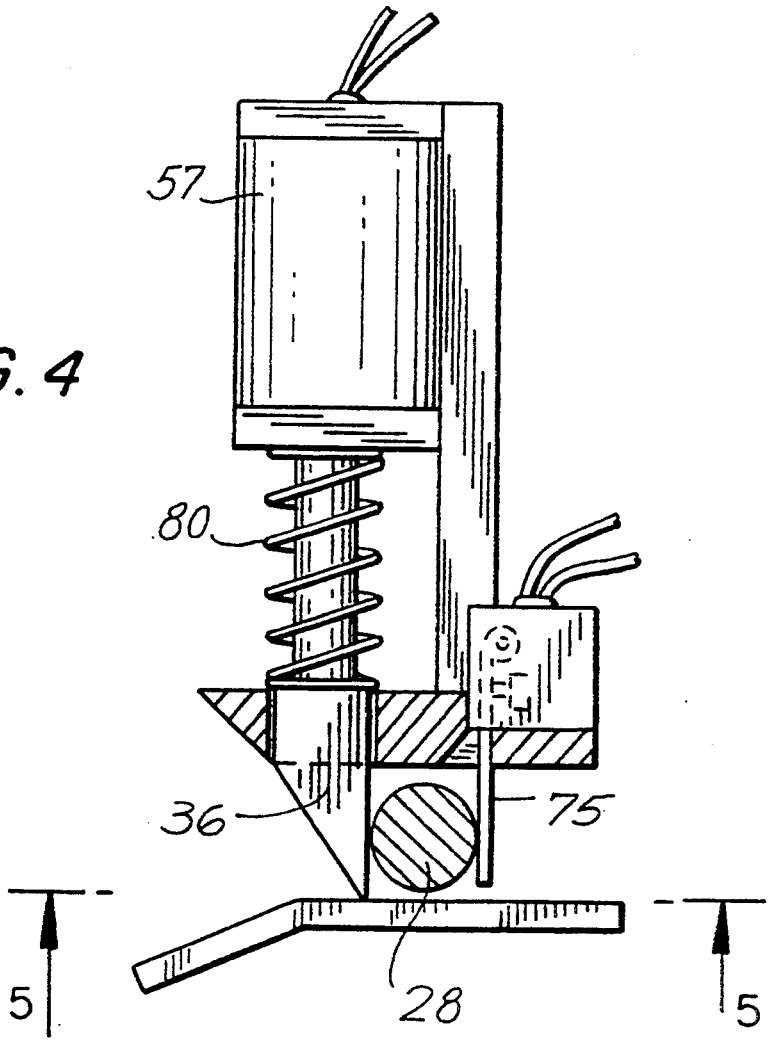
FIG. 4 is a plan detail view of the beveled clamping member locking mechanism as shown in FIG. 3.
Figure 5:
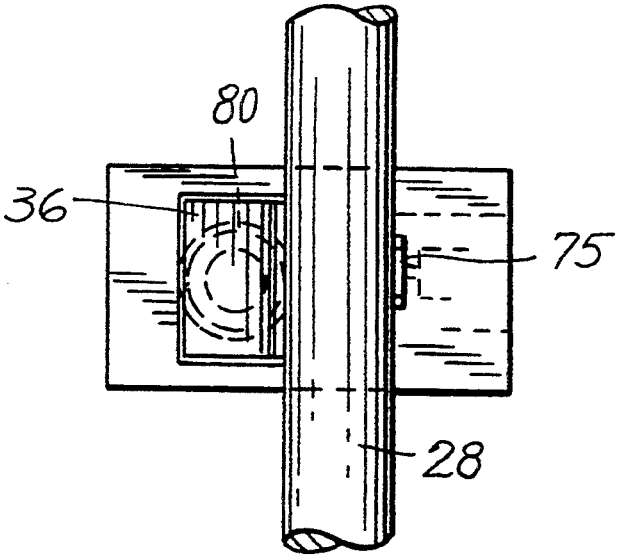
FIG. 5 is a cut-away fragment of the clamping means as viewed at the vertical plane 5—5 of FIG. 4.
Figure 6:
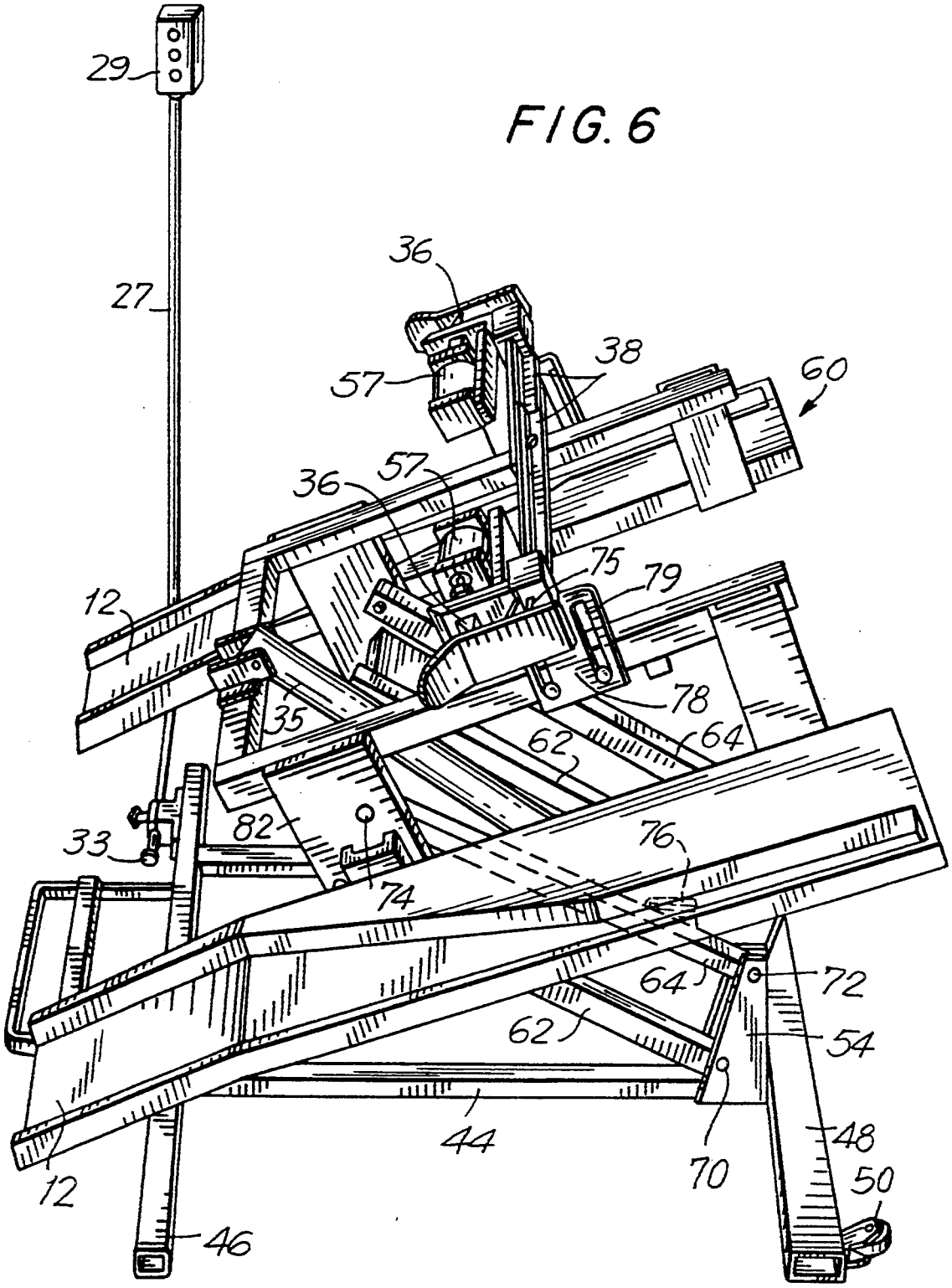
FIG. 6 is a perspective side or elevation view of the invention embodiment shown in FIG. 1 in a raised or up position.

Referring now to the illustrations in FIGS. 1–8, FIG. 1 shows a preferred embodiment of my invention 10 shown in the lowered position. Referring to FIGS. 2,3, and 6, the device for elevating and tipping the seat of a wheel chair forward is comprised of a rectangular rigid base frame 40 which is formed with left and right side members 42, front member 46, and rear member 48.

Figure 7:
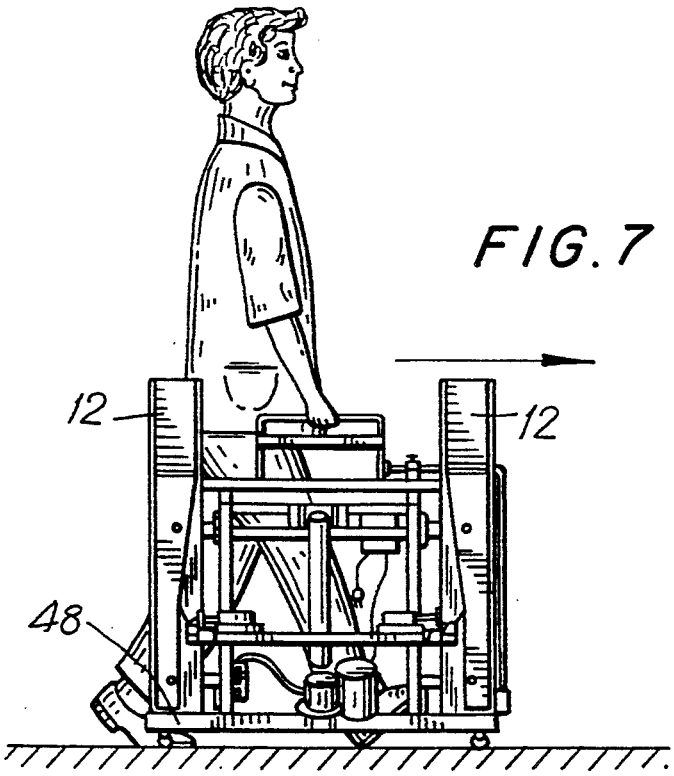
FIG. 7 is the embodiment of the invention shown in FIG. 1 shown in folded configuration for ready portability.

Caster wheels 50 are mounted to the rear member 48 in the plane of the rigid base frame. FIG. 7 illustrates our invention in its closed configuration placed in an upright position resting on castors 50 to facilitate convenient portability.

Left side and right side fulcrums 54 respectively are fixedly mounted to the respective base frame side members 42 approximately in alignment with the rectangular base frame rear member 48, as shown in FIG. 6.

A movable rigid rectangular upper frame 60, as shown in FIG. 6, is hingedly and transitionally mounted to the rigid base frame 40 through respective rotatively mounted left side and right side non-parallel lever arm sets 62 . The non-parallel lever arm sets 62 are respectively mounted to base frame 40 by the respective fulcrum sets 54. The non-parallel lever arm action is achieved by the fact that lever arm sets 62 are rotatively mounted to fulcrum sets 54 in spaced relationship, and secured to the upper and lower arms of each set of lever arms by an upper and lower pin, 72 and 70 respectively.

Lever arm sets 62 are similarly rotatively mounted to left and right anchor plates 82 by means of upper and lower pins 74 and 73, respectively. The anchor plates are in turn rigidly affixed to the upper frame 60 and form an integral part thereof.

Two parallel left and right wheelchair receiving tracks 12 are securely mounted to the upper frame 60 in such a manner that the upper frame 60, parallel wheelchair receiving tracks 12, and a wheelchair secured thereupon are all raised and forwardly tipped together. The parallel tracks are molded in a tapered grove on the interior thereof so as to provide a wide opening at the front end of the lift for receiving the wheels of a wheelchair backing into the lift and a narrower configuration toward the rear of the lift for holding the rear wheels in place when the wheelchair is fully positioned on the lift.

The parallel track 12 mountings are laterally adjustable to accommodate the varying widths of conventional wheelchairs. As shown in FIG. 3, the lateral adjustment is achieved by mounting parallel tracks 12 securely to lateral adjustment rails 15, each rail 15 having a through-cut channel permitting manually operated nut-and-bolt means to secure parallel tracks 12, in a variety of independent laterally related positions. Lateral adjustment rails 15 are secured to and form an integral part of the second hinged frame 60.

A conventional design wheelchair 16 is shown in FIG. 1 positioned on the adjustable parallel tracks 12, the wheelchair having left and right side frames 28.

All wheelchair designs have in common some form of side frame structures onto which the large rear wheels are mounted. It is the rear portion of wheelchair side frames of whatever design on to which our device is designed to clamp releasably. Thus, clamping means are an integral part of our invention, and it is also critical that the clamping means be adjustable both vertically and horizontally.

Motive power for raising and lowering the upper frame is provided by a shaded pole electric motor 32, having a hinged mounting bracket 31 projecting from its casing to permit the motor to be hingedly affixed to the rear member 48 and positioned in the center portion of the rectangular base frame 40, as shown in FIGS. 3 and 6. The hinged mounting bracket 31, together with a pin secures the motor and permits its free movement through an arc between a raised and a lowered position.

The shaded pole motor shaft rotates clockwise or counterclockwise in response to power from a 3-position switch 29 as shown in FIGS. 1, 2, 3 and 6. The switch 29 has an up-position, a horizontal off-position, and a down-position, the respective up and down positions corresponding to the direction of motion desired by the operator of the wheelchair elevating device. Switch 29 is mounted on an adjustable switch stanchion 27 which can move between an upright position and a forward folded position which is 90 degrees of arc from the upright position, and which facilitates convenient transportation of the device. An extension of switch stanchion 27 is secured by manually operated securing clamp 33, shown in FIGS. 1 and 3, which allows for securing stanchion 27 after either raising or lowering.

As shown in FIGS. 3 and 6, the shaft of the motor is connected by a gearbox 39 to a wormgear 34 which rotates in geared response to the motor. The wormgear extends away from the motor and gear box assembly and is inserted into an elongated threaded shaft member 35, the threads of shaft 35 mating with those of the wormgear 34. As the wormgear 34 is caused to rotate by the shaded pole motor 32, the threaded shaft 35 is either thrust away from or pulled toward the position of the electric motor 32, depending upon the direction of motor shaft rotation.

The threaded shaft 35, in turn, is hingedly mounted by means of a pin onto the upper frame 60 in such a manner that forced movement of the threaded shaft 35 causes the entire upper frame 60 to move alternately between its raised and lowered positions, depending on the direction of rotation of the shaded pole motor-wormgear assembly. The free motion of the shaded pole motor 32 about its toggle mount provides for continuous matching alignment between the motorshaft-and-wormgear assembly and the threaded shaft 35 pin-mounted to the upper frame 60 as the upper frame 60 travels between its raised and lowered positions.

Figure 8:
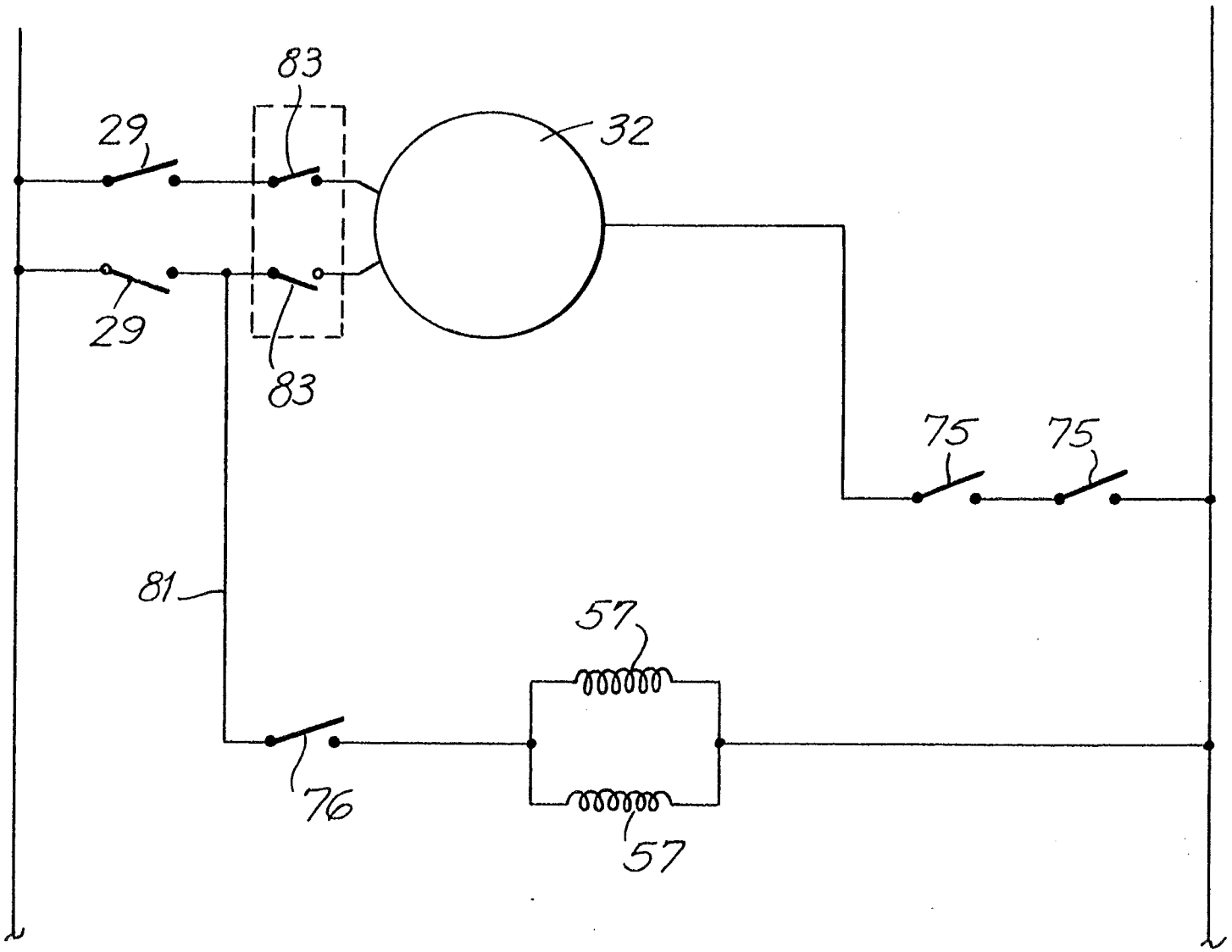
FIG. 8 is a schematic diagram of the electrical circuits in the embodiment of the invention shown in FIG. 1.

The arrival of the upper frame 60 at its end-of-travel point for the fully raised or fully lowered position is sensed by a rotation-limiting circuit component, as shown in FIG. 8, the component comprising limit switches 83 and counter means which count, respectively, discrete clockwise or counterclockwise rotations of the shaded pole motor shaft. When the required number of motor shaft rotations has been achieved and sensed by the counter means in either the up or down direction, the counter means communicates with and opens the appropriate up or down limit switch 83. The limit switches are in series connection with the shaded pole motor and the 3-position switch. The rotation of the wormgear 34 is thus limited to a specific number, respectively, of clockwise or counterclockwise rotations. In turn, the travel of the threaded shaft 35 has maximum extension and minimum retraction limits and thus the entire upper frame 60 has upper and lower position limits. Within such limits the device can be stopped in an infinite number of intermediate positions providing varying degrees of assistance to the user.

As illustrated in FIGS. 3, 4, and 5, the clamping and holding of a wheelchair into the present invention is achieved by a pair of solenoid-activated left and right beveled clamping members 36, which are mounted on a pair of respective right and left lateral adjustment members 38. Lateral adjustment members 38 are elongated structural components, each having a through-cut channel to accept one or more manually-operated securing bolts 37 which are alternately loosened and tightened to provide lateral adjustment. The lateral adjustment members 38 slide horizontally in matable relationship with each other and remain in contact with each other. Since beveled clamping members 36 are attached to lateral adjustment members 38, the desired spaced-apart adjustment of beveled clamping members 36 can be achieved in order to accommodate conventional wheelchairs of varying widths.

Lateral adjustment members 38, with beveled clamping members 36, are in turn mounted to a right and left side pair of vertical adjustment plates 78, as shown in FIGS. 2 and 6. Vertical adjustment plates 78 are each provided with two parallel through-cut channels 79 permitting slidable vertical motion. Vertical adjustment plates 78 are each secured to the upper frame 60 by a pair of manually operated securing bolts inserted through channels 79 in plates 78 and further inserted through a receiving aperture in the upper frame 60. Thus, by attachment to lateral adjustment members 38 and vertical adjustment plates 78, beveled clamping members 36 are secured to the upper frame 60 to allow for manual adjustment in both lateral and vertical directions.

Clamping members 36 move to an open position to permit entry of wheelchair side frame members 28, after which clamping members 36 close, thereby blocking the exit of the wheelchair side frame from its now-secure position in and upon the upper hinged frame 60. As long as clamping members 36 remain in the closed position, the secured wheelchair cannot move from its position in the device of the present invention. The wheelchair lift-assisting device of the present invention is then normally operated by energizing the up position of three-position switch 29 for upward motion of the upper frame 60 bearing the chair, and similarly energizing the down position of switch 29 for downward motion of the wheelchair.

As illustrated in FIGS. 3 and 4, clamping members 36 are urged into a normally-closed position by a right and left pair of springs, 80. Clamping members 36 are provided with elongated shafts which extend laterally into a respective pair of right and left solenoids, 57. Solenoids 57 are normally not energized, and thus springs 80 normally maintain beveled clamping members 36 in the closed position. Only when solenoids 57 are energized are the elongated shafts 82 of beveled clamping members 36 drawn laterally into the solenoids, thereby compressing springs 80 and causing the clamping members 36 to assume an open position. As soon as energy to solenoids 57 is terminated, the elongated shafts 82 are released and springs 80 return the beveled clamping members 36 to their respective closed positions.

Solenoids 57 are manually operated by energizing the downward position of three-position switch 29. However, for safety, the electric circuit component on which the solenoids 57 are connected is further controlled by a chair-down microswitch 76, shown in FIG. 6, mounted on uppermost of the lever arms 62 in a position which closes microswitch 76 only when the device reaches its full-lowered position. Solenoids 57 are then and only then retractable by energizing the downward position of switch 29.

As illustrated in FIGS. 6 and, 8, the down position of switch 29 may actuate either lowering motion of second frame 60 or retraction of solenoids 57, depending on the position of second frame 60. When second frame 60 is at any point above its fully lowered position, the chair-down microswitch 76 is open, preventing energy from reaching solenoids 57 and insuring against premature release of the raised wheelchair. In such a raised position, energizing the down position of switch 29 serves only to energize motor 32 in the downward direction.

Up and down limit switches 83, as shown in FIG. 8, are responsive to counted rotations of the shaft of motor 32. The counting of rotations is accomplished by counter means which are connected to limit switches 83 and cause the opening thereof for the appropriate up or down direction when the required number of rotations have been achieved and sensed. When the appropriate up or down limit switch 83 opens, motor 32 halts, and further halts motion of the upper frame 60, which has achieved the limit of its travel in the then-current direction, i.e., either up or down.

In the downward direction, then, the arrival of second frame 60 is sensed by the appropriate rotation counter means and downward movement of the upper frame 60 halts. This halt occurs coincidentally with the mechanical compression and electrical closing of chair-down microswitch 76.

The circuit of the wheelchair lift device of the present invention is so designed that an electrical connection 81 shown in FIG. 8 is provided between the down position of switch 29 and chair-down microswitch 76. Thus, only when the upper frame 60 is fully lowered and switch 76 is compressed and closed, does the down position of switch 29 result in energizing the solenoids 57.

Once energized, solenoids 57 laterally withdraw beveled clamping members 36 from their locked position, releasing the wheelchair side frames. Solenoids 57 may be fitted with an optional time-delay means to permit an operator to release pressure upon the down position of switch 29 without incurring an immediate return of beveled clamping members 36 to their locked position. Such a time delay would permit an operator to roll a wheelchair onto or off the device conveniently. After the elapse of the time delay interval, the solenoid-retracted beveled clamping members 36 would automatically be pushed back into their locked position by springs 80. To recapitulate, only in the full lowered position of upper frame 60 will activating the downward position of switch 29 send electrical energy through circuit connection 81 so as reach and activate solenoids 57 and any time delay means associated with the solenoids As a further safety measure, lateral adjustment members 38 are further provided with a respective pair of right and left microswitches 75, as shown in FIGS. 3, 4, and 8, which are mechanically responsive to a wheelchair side frame being secured into the device of the present invention by beveled clamping members 36. With a wheelchair thus in place and secured, microswitches 75 are closed, permitting electric current to flow through the circuit operating electric motor 32 and thus raising or lowering upper frame 60 with a wheelchair in place. Microswitches 75 thus prevent the device from moving upward or downward unless a wheelchair is firmly secured by beveled clamping members 36.

What is claimed is:

1. A device for clamping and forwardly tipping a wheelchair, comprising:

a fixed rectangular frame;

a second upper frame hingedly mounted to the rectangular frame, the second frame being movable between a raised position and a lowered position;

parallel tracks adjustably positioned to receive the wheels of a wheelchair, the parallel tracks being mounted on the second frame;

an electric motor having a rotatable shaft projecting therefrom, the shaft being capable of rotating clockwise or counterclockwise, the motor being further provided with an exterior casing and a hinged mounting bracket integral with and attached to the exterior casing, wherein the hinged mounting bracket provides for hinged rotational motion between a raised position and a lowered position of said casing, the hinged mounting bracket being further provided with a pin, the hinged mounting bracket being secured to the rectangular fixed frame by the pin;

a three-position electric switch having an upward position, a horizontal off position, and a downward position, wherein the switch is electrically connected to the motor;

a gear box means for transmitting rotational motion from the electric motor, the gear box means being fixedly mounted-to the electric motor;

a wormgear being rotationally mounted to the gear box means to receive rotational motion transmitted from the electric motor;

a threaded member hingedly mounted to the rectangular frame, the threads of said threaded member mating with the wormgear so as to either thrust the threaded member away from the gear box means and motor or to pull it toward the gear box means and motor; and locking means and solenoid means such that the solenoid means actuates the locking means for grasping and fixedly securing a wheelchair rolled onto the parallel tracks, and further wherein the solenoid means and locking means are mounted to the second hinged frame so as to be in horizontally and vertically adjustable relationship with the second hinged frame.

2. The device of claim 1, wherein the electric motor is a shaded pole motor.

3. The device of claim 2 having a circuit comprising two contact switches, the motor, and the three position switch, the contact switches being mounted at the rear of the two parallel tracks respectively and positioned to remain open until the respective side frames of a wheelchair positioned in the parallel tracks contact and thereby close the contact switches; the contact switches being wired in series and electrically connected between the motor and simultaneously with the upward and downward positions of the three position switch, whereby the circuit cannot be closed and the motor activated, and further whereby the hingedly mounted upper frame with parallel tracks cannot be raised or lowered unless both contact switches are closed by the side frames of a correctly positioned wheelchair on the parallel tracks.

4. The device of claim 3 wherein a contact microswitch is mounted to the rectangular frame such that it is in a closed position when the hingedly mounted upper frame is in its fully lowered position and further wherein the contact microswitch is open when the hingedly mounted upper frame is rotated from its lowered position, and wherein the solenoid means are wired in series with the contact microswitch, such that the solenoid means may be energized and the locking means may be released only when the hingedly mounted upper frame is in its fully lowered position, thus assuring that the wheelchair may not be released from the parallel tracks unless the hingedly mounted second frame is in a fully lowered position.

5. The device of claim 4, wherein the locking means are provided with springs for urging the locking means into a locked position.

6. The device of claim 5 wherein the three position switch is mounted on a vertical stanchion, the stanchion being adjustable between a vertical position and a horizontal position for conveniently transporting the device.

7. The device of claim 6, being further provided with a counter means to count the rotations of the electric motor, said counter means providing a part of a stop limit system during raising and lowering of the second frame to its respective fully raised or fully lowered positions.

8. The device of claim 7, further having up and down limit switches in series connection with the motor and the three position switch, the counter means being electrically connected to and causing the opening of the up limit switch and the down limit switch, respectively.

9. The device of claim 8 wherein the downward position of the three position switch when the device is in a fully lowered position causes current to flow to the solenoids and causes the locking means to retract, thereby releasing a wheelchair secured therein.

10. The device of claim 9, wherein the solenoids are provided with time delay means such that they remain activated for an interval of time after the switch which actuated them has been released.

* * * * *